United States Patent [19]

Berliner et al.

[11] Patent Number: 4,820,236

[45] Date of Patent: Apr. 11, 1989

[54] DOLL WITH SENSING SWITCH

[75] Inventors: William Berliner, Essex, Conn.; Mark B. Johnson-Williams, East Longmeadow, Mass.

[73] Assignee: Coleco Industries, Inc., West Hartford, Conn.

[21] Appl. No.: 111,364

[22] Filed: Oct. 22, 1987

[51] Int. Cl.[4] ..... A63H 3/28

[52] U.S. Cl. ..... 446/369; 446/485; 310/311

[58] Field of Search ..... 446/297, 299, 300, 175, 446/302, 369, 454, 485, 486, 140, 484, 404; 310/311

[56] References Cited

U.S. PATENT DOCUMENTS

| | | | |
|---|---|---|---|
| 2,752,730 | 7/1956 | Bellett et al. | 446/353 |
| 3,167,668 | 1/1965 | Nesh | 310/340 |
| 3,229,421 | 1/1966 | Ostrander | 446/304 |
| 3,747,176 | 7/1973 | Toyoshima | 29/25.35 |
| 3,805,509 | 4/1974 | Assmus et al. | 368/159 |
| 3,808,418 | 4/1974 | Conard et al. | 446/369 |
| 4,085,542 | 4/1978 | Mitamura | 446/175 |
| 4,088,315 | 5/1978 | Schemmel | 272/76 |
| 4,125,962 | 11/1978 | Torrejon et al. | 446/484 |
| 4,182,077 | 1/1980 | Wagner et al. | 446/484 |
| 4,237,647 | 12/1980 | Shaw | 446/303 |
| 4,305,223 | 12/1981 | Ho | 446/392 |
| 4,333,262 | 6/1982 | Kimura | 446/484 |
| 4,355,483 | 10/1982 | Korzelius | 446/484 |
| 4,464,861 | 8/1984 | Fogarty et al. | 446/370 |
| 4,479,329 | 10/1984 | Fraden | 446/175 |
| 4,505,687 | 3/1985 | Munro | 446/369 X |
| 4,536,673 | 8/1985 | Forster | 310/327 |
| 4,612,472 | 9/1986 | Kakizaki et al. | 310/339 |
| 4,682,502 | 7/1987 | Miyoshi et al. | 338/35 X |
| 4,748,366 | 5/1988 | Taylor | 446/485 X |

*Primary Examiner*—Richard J. Johnson
*Assistant Examiner*—Sam Rimell

[57] ABSTRACT

A doll contains a flexible sensor which is captured in the doll near a surface thereof and will emit an electrical signal when subjected to bending or pressure to indicate that this part of the doll is being touched or manipulated. The sensor utilizes a film having piezoelectric properties to generate a signal when subjected to such forces.

4 Claims, 3 Drawing Sheets

DOLL WITH SENSING SWITCH

FIELD OF THE INVENTION

This invention relates to a doll containing a novel sensing assembly which will indicate when a doll part is touched or manipulated.

BACKGROUND OF THE INVENTION

Various dolls or toys have been proposed which have switches therein which, when activated, will cause a predetermined movement or response from the doll or toy. For example, U.S. Pat. No. 4,088,315 discloses the use of pressure responsive switches in a dummy for use in karate training and includes pressure responsive switches for detecting and measuring blows. U.S. Pat. No. 4,237,647 discloses a toy containing electric contacts in each of its arms which, if closed, complete a circuit and cause a reaction of the toy. Other prior art toys or dolls utilizing switches to detect a condition are shown in U.S. Pat. Nos. 3,229,421 and 4,464,861.

However, these known prior art devices contain conventional make or break type switches which occupy a substantial volume of space and which may possibly become dislodged from a desired position within the doll. Dolls' appendages, in many cases, comprise a tubular covering or "skin" which is filled with a stuffing which may be fibrous or particulate. Such stuffing may be rearranged within the covering due to handling, and thus could cause displacement of a switch located therewithin.

Accordingly, the present invention provides a new and improved doll construction which includes a pressure or bending sensing device to emit an electrical signal upon pressure or manipulation of the section of the doll in which it is disposed.

SUMMARY OF THE INVENTION

Briefly stated, the invention in one form thereof comprises a thin, flexible piezoelectric sensor which is trapped or encapsulated in a portion of a doll. The sensor includes a thin film of a material exhibiting a piezoelectric effect, such as polyvinylidene fluoride, sandwiched between two flexible electrodes providing electrical contact with the piezoelectric film. Leads are taken from the sensor to a signal processing device, such as an amplifier or a switching device such as a field effect transistor.

The sensor is encapsulated or captured in the doll, preferably adjacent to a surface thereof, and the material of the doll holds the sensor in a predetermined position. Any motion of that portion of the doll or pressure exerted on the sensor may cause bending of the flexible sensor and generation of a signal through the piezoelectric effect.

In the case of a doll which includes a speech synthesizer with a vocabulary in memory and a central processing unit (CPU), this doll sensor construction may be utilized to produce predetermined speech from the speech synthesizer. Alternatively, the logic of the doll may be programmed with a routine that would request a person playing with the doll to take certain action, such as, "squeeze my arm", "touch my leg", etc, and the sensor would signal the CPU that the action has been taken.

An object of this invention is to provide a new and improved doll construction with a flexible piezoelectric sensing means therein to sense manipulation of the doll.

Another object of this invention is to form such a doll construction wherein the sensor is captured in a desired location and is not subject to displacement in the doll.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DESCRIPTION OF PREFERRED EMBODIMENT OF THE INVENTION

Figure 1:
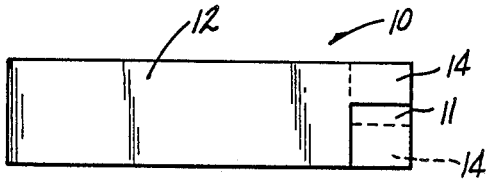
FIG. 1 is a plan view of a sensor utilized in the invention.
Figure 2:
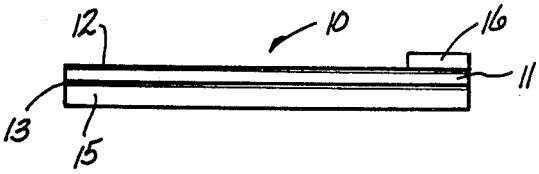
FIG. 2 is a side elevation of the sensor of FIG. 1 with structural parts added.
Figure 3:
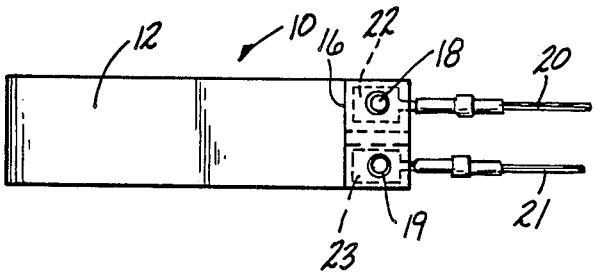
FIG. 3 is a plan view of the sensor of FIG. 2 with electrical connections and leads added.

Reference is now made to FIGS. 1–3 wherein a sensor 10 embodying the invention includes a thin film 11 of a piezoelectric material, such as polyvinylidene fluoride which exhibits piezoelectric properties when bent or otherwise distorted from its at rest configuration. Such material is available under the trademark KYNAR from the Pennwalt Company of Valley Forge, Pa.

Disposed on opposite surfaces of film 11 are electrically conductive flexible electrodes 12 and 13 which will receive an electrical signal when the film 11 is subjected to bending or other stress. The electrodes 12 and 13 may be vacuum metallized thereon, or formed by a conductive ink applied thereto, or made of foil bonded and to the piezoelectric film with an electrically conductive adhesive. Each electrode 12, 13 has a leg portion 14 at one end and these are not superposed to provide areas for connection of leads to each electrode. When the electrodes 12, 13 are vacuum metallized upon the film 11, the leg portions 14 may be formed of conductive ink.

The film and electrodes are extremely thin, on the order of 0.001 inch, and have little structural strength. Therefore, a strip 15 of flexible and resilient material such as polyvinyl chloride or polyvinylidene chloride is bonded to the electrode 13 to provide structural support while maintaining resilient deflectability for the sensor 10. The strip 15 may be on the order of 0.005–0.010 inch thick. A small strip 16 of non-conductive material is placed over the end of the sensor 10 at the leg portions 14 to reinforce the sensor 10 for application of eyelet type connectors 18 and 19 which secure leads 20 and 21 with spade-type connectors 22 and 23 to the electrode leg portions 14 and make electrical connection therewith. The thickness of film 11, electrodes 12 and 13, and members 15 and 16 are exaggerated in FIG. 2 for clarity of illustration.

Figure 4:
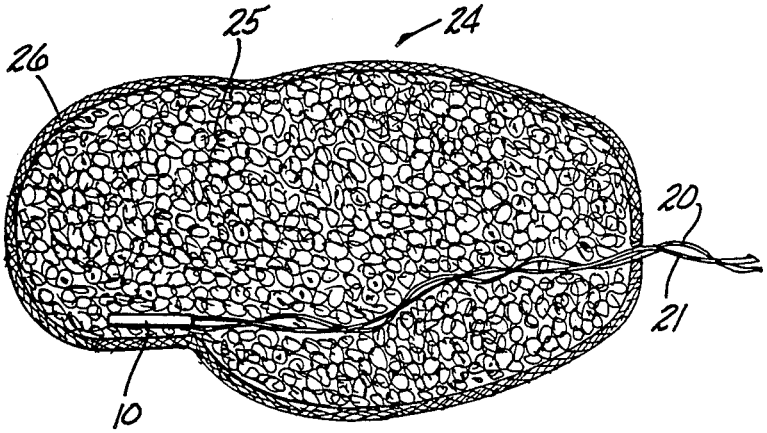
FIG. 4 is a cross sectional representation of a doll's arm in a construction embodying the invention.

FIG. 4 exemplifies a portion of a doll in the form of an arm 24 showing the sensor 10 therein fixedly embedded in a plastic foam material 25 which is resiliently deflectable and which is covered by a smooth cloth covering 26. The covering 26 is initially open at the end through which the leads 20 and 21 extend, but this opening is stitched closed in the illustration. As indicated, the bulk of the arm 24 is formed of a foamed resinous material which will secure the sensor 10 in a predetermined location by its encapsulation therein.

Figure 6:
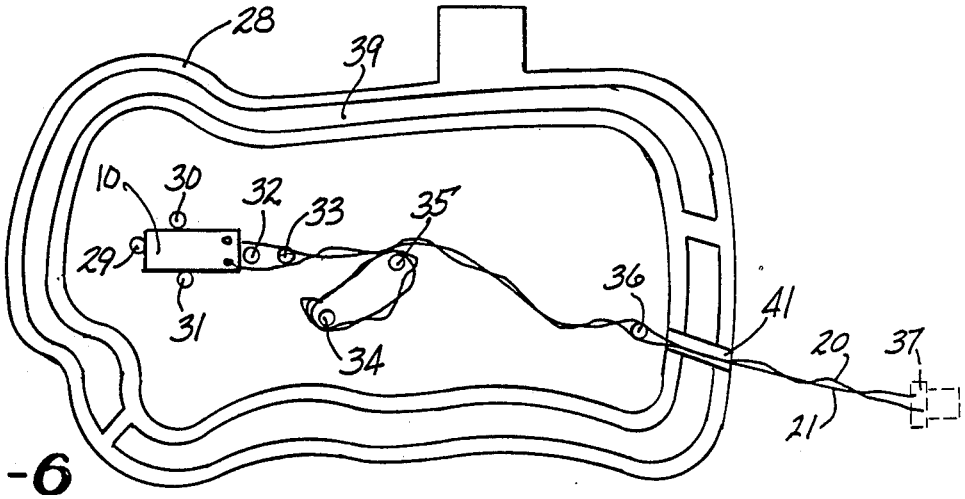
FIG. 6 is a plan view of the bottom portion of the mold of FIG. 5, with the top removed.
Figure 5:
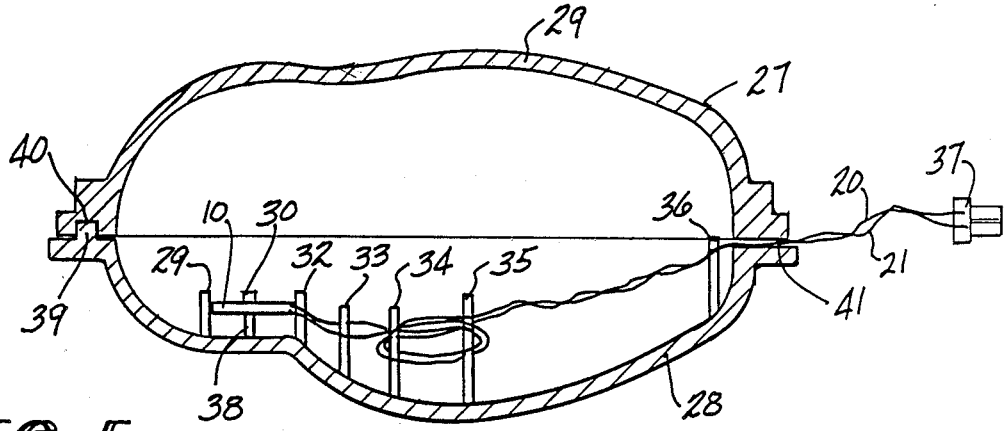
FIG. 5 is a half-section view of a mold in which the doll arm of FIG. 4 is formed with the sensor assembly disposed therein.

FIGS. 5 and 6 illustrate a mold 27 which comprises a lower section 28 and an upper section 29, and it includes means to position the sensor 10 and its electrical components during molding of the doll arm comprising the doll part 25 seen in cross section in FIG. 4.

FIG. 6 is a plan view of mold section 28, which has locating pins 29, 30, 31, and 32 extending upwardly therefrom to locate sensor 10, and it may also have pins 33, 34, 35, and 36 to support the electrical leads 20 and 21 to the connector 37 (shown in FIG. 5). A small peg 38 may be provided to support sensor 10 between pins 29–32 and locate it at a desired position with respect to the mold surface.

The doll part 24 is preferably produced at substantially ambient temperatures by introducing a resin formulation thereinto and effecting foaming and expansion by catalytic reaction. The foamable resinous material is preferably a polyester, polyurethane or other resilient resin. Exemplary of a suitable material is a resin available from the Mobay Chemical Company under the designation BAYFIT No. 550, which is a two-part polyurethane.

The mold halves 28 and 29 are formed with a tongue 39 and groove 40 fitting, and with a passage 41 for leads 20 and 21 therethrough. Any flash may be trimmed when the part 25 seen in FIG. 4 is removed from the mold.

After curing, the foamed doll part 25 seen in FIG. 4 may be removed from the mold. The foamed part will easily slide off the supporting pins, and the expansion of the foam will fill the recesses previously defined by the pins. Then a stocking-like covering or skin 26 is utilized to cover the foam.

It will be noted that the sensor 10 is positioned closely adjacent the surface or "skin" of the doll part so that it may sense any bending of the doll part in that area, or any pressure exerted thereon. The use of the foam body of the doll part 25 to encapsulate the sensor 10 thus controls the location of the sensor 10 and maintains it in that location.

The piezoelectric film may be of relatively small size; dimensions of $\frac{3}{4}$–2 inches in length and $\frac{1}{4}$–1 inch in width may be satisfactory for most applications. An element in a commercial structure of applicants' assignee has dimensions of $\frac{3}{8}$ inch $\times$ 1 inch. The film will normally have a thickness of about 0.004–0.015 inch. When the film is bent or otherwise subjected to stress, it emits a signal of very small amperage (on the order of 50–200 nanoamperes) and a voltage of about 30–50 volts. This signal may be amplified to operate directly a switch (or transistor), for another electrical device, or it may be processed in a buffer and channelled to an electronic component such as a central processing unit (CPU) to indicate action on that part of the doll which may then result in a further action by the CPU. In a present commercial embodiment, the doll includes a speech processor and the CPU causes the speech processor of the doll to make a request such as "Hold my hand". If the child does so, pressure on a sensor in the hand portion of the doll sends a signal to the CPU which then recognizes that the requested action has been performed.

Figure 7:
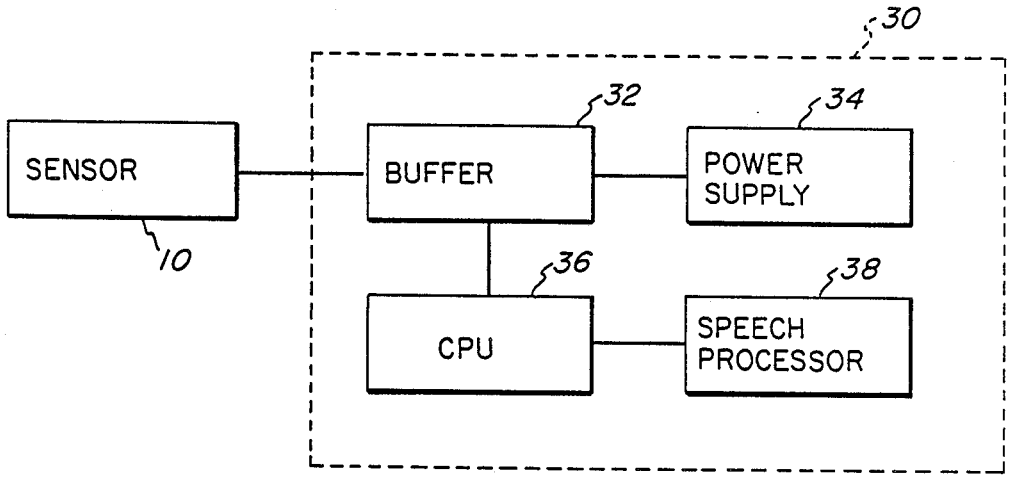
FIG. 7 is a schematic diagram of a doll circuit embodying the present invention.

A simple diagrammatic circuit of a doll assembly embodying the invention is shown in FIG. 7. As seen, the sensor 10 sends the signal to the device to be controlled by or respond thereto, and indicated by the broken line 30. In this embodiment, the device 30 includes a buffer 32, a power supply 34 (a battery pack), a CPU 36, and a speech processing unit 38.

The CPU 36 causes the speech processing unit 38 to make an utterance requiring the child to act upon a portion of the doll. If the child acts upon a doll part containing a sensor 10, the piezoelectric file generates a signal which is processed through the buffer 32 to the CPU 36. If the CPU determines that the proper sensor 10 has been acted upon, then a further utterance may be made to reflect such proper action.

As will be appreciated, the resiliently flexible sensors of the present invention are easily disposed within the body of the doll and do not provide a hard spot within an otherwise soft body for the doll so as to present a potential for injury or to make it less "snugglely". The sensor can be located closely adjacent to the surface or it can be disposed well within the body of the material underlying the skin depending upon the sensitivity to pressure or bending required.

Although polyvinylidene fluoride is the most commonly available piezoelectric film, other polymers and flexible ceramics and composite materials may also be used as the piezoelectric element so long as they provide the desired resilient deflectability.

It may thus be seen that the object of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. In combination, a doll or the like having a simulated figure portion which is resiliently deformable, said portion having a simulated flexible skin providing the outer surface thereof and a filler therewithin; a resiliently deflectable piezoelectric sensing element secured in said figure portion closely adjacent to said outer surface thereof, said sensing element comprising a flexible piezoelectric synthetic resin film which generates an electrical signal when subjected to stress, and a pair of electrodes in electrical contact with said film; an electrical sound generating device within said doll, the flexibility of said sensing element substantially eliminating any hard spot in said figure portion where it is disposed; and electrical leads extending from said electrodes of said sensing element to said device to transmit a signal to said device, said sensing element being sensitive to pressure applied to said skin disposed thereover to cause deflection thereof and thereby generate a signal.

2. The combination of claim 1, wherein said sensing element includes a resiliently deflectable backing strip adhered to one of said electrodes.

3. The combination of claim 1 wherein said filler is a foamed synthetic resin material and said sensing element is encapsulated within said foamed synthetic resin material.

4. The combination of claim 1 wherein said piezoelectric synthetic resin of said film is polyvinylidene fluoride.

* * * * *